United States Patent [19]

Deiner et al.

[11] Patent Number: 4,834,764

[45] Date of Patent: May 30, 1989

[54] PROCESS FOR OBTAINING WASH-AND CLEANING RESISTANT TEXTILE FINISHES WITH REACTIVE PERFLUOROALKYL-CONTAINING (CO) POLYMERS AND/OR PRECONDENSATES AND A BLOCKED ISOCYANATE COMPOUND

[75] Inventors: Hans Deiner, Neusäss; Bernhard Sandner, Diedorf; Franz Mosch, Gessertshausen; Willy Bernheim, Diedorf, all of Fed. Rep. of Germany

[73] Assignee: Ciba-Geigy Corporation, Ardsley, N.Y.

[21] Appl. No.: 124,339

[22] Filed: Nov. 20, 1987

Related U.S. Application Data

[63] Continuation of Ser. No. 871,439, May 22, 1986.

[30] Foreign Application Priority Data

Sep. 28, 1984 [DE] Fed. Rep. of Germany ..... 3435618

[51] Int. Cl.[4] ..... D06M 15/66; C08L 83/04

[52] U.S. Cl. ..... 8/115.64; 8/115.51; 8/115.6; 8/115.67; 8/192

[58] Field of Search ..... 8/115.64, 115.67, 192

[56] References Cited

U.S. PATENT DOCUMENTS

| | | | |
|---|---|---|---|
| 3,356,628 | 12/1967 | Smith et al. | 524/544 |
| 3,503,915 | 3/1970 | Peterson | 8/183 |
| 3,506,661 | 4/1970 | Enders et al. | 268/249.6 |
| 3,528,849 | 9/1970 | Vullo et al. | 427/393.4 |
| 3,968,066 | 7/1976 | Mueller | 524/236 |
| 4,124,553 | 11/1978 | Guise | 8/127.6 |
| 4,240,943 | 12/1980 | Sugawara et al. | |
| 4,477,498 | 10/1984 | Deiner et al. | 427/389.9 |
| 4,571,417 | 2/1986 | Thoma et al. | 525/63 |
| 4,606,974 | 8/1986 | Thoma | 428/447 |
| 4,781,844 | 11/1988 | Kortmann et al. | 252/8.6 |

FOREIGN PATENT DOCUMENTS

| | | |
|---|---|---|
| 3307420 | 9/1984 | Fed. Rep. of Germany . |
| 1316488 | 12/1962 | France . |
| 53-033251 | 3/1978 | Japan . |
| 53-035098 | 4/1978 | Japan . |
| 53-065492 | 6/1978 | Japan . |
| 53-086899 | 7/1978 | Japan . |
| 58-034866 | 3/1983 | Japan . |
| 999795 | 7/1965 | United Kingdom . |
| 1157796 | 7/1969 | United Kingdom . |
| 1335192 | 10/1973 | United Kingdom . |

OTHER PUBLICATIONS

PCT/EP85/00478, Sep. 17, 1985, Title: Method for Obtaining a Coating for Wash- and Cleaning-Resistant Textiles Comprised of Reactive Perfluoroalkyl Rest-Containing (co)Polymers and/or Precondensates.

6001 Chemical Abstract 99 Dec. (1983) No. 26, p. 100.

CPI Basic Abstract Journal (1978) Nippon Synth. Chem. Ind., J53033-251.

CPI Basic Abstract Journal (1978) Dainichi Seika Kogy KK (Ukim-) J53065-492.

CPI-Japanese 53033251 (Abstract).

CPI-Japanese 53035098 (Abstract).

CPI-Japanese 53086899 (Abstract).

CPI-Japanese 53065492 (Abstract).

*Primary Examiner*—A. Lionel Clingman

*Attorney, Agent, or Firm*—Edward McC. Roberts

[57] ABSTRACT

The present invention relates to a process for obtaining wash- and cleaning-resistant textile finishes by impregnating with customary reactive perfluoroalkyl-containing (co)polymers and/or precondensates in aqueous dispersion and concluding heating, wherein the dispersions have NCO-containing compounds which have a molecular weight of at least 450 and/or contain a diphenylmethane-based polyisocyanate mixture in blocked form.

The process according to the invention has made it possible to equip textiles with water-repellant and oil-repellant finishes which are very highly wash- and cleaning-resistant.

10 Claims, No Drawings

PROCESS FOR OBTAINING WASH-AND CLEANING RESISTANT TEXTILE FINISHES WITH REACTIVE PERFLUOROALKYL-CONTAINING (CO) POLYMERS AND/OR PRECONDENSATES AND A BLOCKED ISOCYANATE COMPOUND

This application is a continuation of application Ser. No. 871,439, filed May 22, 1986 abandoned.

The present invention describes a process for obtaining wash- and cleaning-resistant textile finishes by impregnating with customary reactive perfluoroalkyl-containing (co)polymers and/or precondensates which contain as reactive groups OH and OR groups respectively, R denoting an alkyl radical of 1 to 3 carbon atoms, in aqueous dispersion and concluding heating, the dispersions containing NCO-containing compounds (low molecular weight polyurethanes having isocyanate groups and/or polyisocyanates) which have a molecular weight of at least 450 and/or a diphenylmethane-based polyisocyanate mixture in block form.

The oil and water-repellant finish with different reactive $R_f$ polymers or $R_f$ precondensates is known (European Offenlegungsschrift No. 073,364; U.S. Pat. No. 3,356,628; $R_f$=perfluoroalkyl radical of at least 4, in particular 6 to 14, carbon atoms). These finishes can be applied together with known finishing agents, especially methylolated compounds or even diisocyanates. The disadvantage is that the finish with the diisocyanates needs to be applied from solvents (aqueous emulsions are unstable) and that the improvement in cleaning stability obtained remains insufficient.

It has now been found that wash- and cleaning-resistant textile finishes with reactive, perfluoroalkyl-containing (co)polymers and/or precondensates from aqueous dispersion are obtained when selected NCO-containing compounds are used in block form.

The present invention thus relates to the process described in claim 1 and to the elaborations of this process described in the subclaims.

The reactive, perfluoroalkyl-containing (co)polymers which contain as reactive groups OH or OR groups in which R denotes an alkyl radical of 1 to 3 carbon atoms are sufficiently well known to those skilled in the art (see for example German Auslegeschrift No. 1,419,505).

They are in general copolymers based on vinyl esters, in particular vinyl acetate and acrylate esters, in particular butyl acrylate. Suitable comonomers are a very wide range of different compounds, such as other acrylates, for example ethyl, methyl or 2-ethylhexyl acrylate, ethylene, styrene, acrylamide and acrylonitrile, which can also contain small amounts of carboxyl-containing monomers, for example itaconic acid and (meth)acrylic acid, or monomers having several double bonds, for example butanediol diacrylate, as copolymerized units. These (co)polymers contain customary perfluoroalkyl-containing monomers as copolymerized units, which can even be the main component. The reactive groups present in the perfluoroalkyl-containing (co)polymers used are N-methylol and N-methylol-(C 1- to C 3-alkyl)ether groups which are incorporated into the copolymer using methylolated and free or etherified (meth)acrylamides or allyl carbamates. But also very highly suitable are OH-containing comonomers, for example hydroxyalkyl (meth)acrylates, such as 2-hydroxyethyl or 2-hydroxypropyl acrylate. The monomers having the reactive groups are generally present in the copolymer in amounts of 2 to 20, in particular 2.5 to 12, % by weight, based on the total polymer. These copolymers are prepared in conventional manner by emulsion copolymerization in aqueous medium.

The reactive compounds used in place of or together with the (co)polymers are reactive perfluoroalkyl-containing precondensates. They are above all the customary free or C 1- to C 3-alcohol-etherified methylolmelamines and methylolurea which are present in perfluoroalkyl-modified form. A typical representative of this group of compounds is described in European Offenlegungsschrift No. 073,364.

Further, less suitable reactive compounds for the process according to the invention are likewise known to those skilled in the art. Examples of $R_f$ polyurethanes containing free OH groups. The term reactive, $R_f$-containing (co)polymers is thus to be interpreted broadly.

Suitable NCO-containing compounds are low molecular weight polyurethanes. These polyurethanes are prepared, as is perfectly well known to those skilled in the art, by reacting polyfunctional, aliphatic, cycloaliphatic, araliphatic and aromatic polyisocyanates, such as, for example, hexamethylene 1,6-diisocyanate, the various isomers of toluylene diisocyanate, diphenylmethane diisocyanate, isophorone diisocyanate and the like, with low molecular weight compounds having at least 2, preferably at least 3, OH groups. Suitable low molecular weight polyols for the reaction are in particular trimethylolpropane, 1,3,5-hexanetriol, glycerol, pentaerythritol or even propylene glycol, hexylene glycol or diethylene glycol. Also suitable are other low molecular weight polyhydroxy compounds, such as triethanolamine. The molecular weight of the polyhydroxy compounds which can be used ranges from 62 to about 400, in particular up to about 250.

The preparation of the low molecular weight polyurethanes which have a molecular weight of at least 450, in particular at least 600, is known per se. To this end, the polyhydroxy compounds mentioned are reacted with an excess of polyisocyanates. The equivalent ratio of OH to NCO groups in the reaction is at least 1:1.3, in particular 1:1.5 to 2.5. The upper limit is variable, but compounds having a ratio of 1:above 6.0 are no longer of particular importance.

In addition to the low molecular weight polyurethanes, polyisocyanates having a molecular weight of at least 450, in particular at least 600, can also be used within the framework of the process according to the invention as NCO-containing compounds after the blocking described hereinafter. Such polyisocyanates are known. Examples which may be mentioned are: trimeric isophorone diisocyanate and trimeric hexamethylene 1,6-diisocyanate or DESMODUR RF (from Bayer AG, Leverkusen).

Also suitable, as sole exception, apart from the higher molecular weight NCO-containing compounds, is a polyisocyanate mixture based on diphenylmethane. These, like the previously mentioned NCO-containing compounds, have surprisingly good emulsifier properties, which, as will be readily understood, is the precondition for their use.

The selected NCO-containing compounds described are used according to the invention not as such but in blocked form. This blocking is effected by reacting these compounds with approximately stoichiometric amounts of blocking agent. After the reaction the free NCO groups have virtually all disappeared. Suitable blocking agents are phenols, malonate esters, acetoacetate esters and other known substances, but preferably C 2- to C 8-alkanone oximes, in particular butanone oxime (see for example European Offenlegungsschrift No. 107,838). The blocked NCO-containing compounds can be split open by heating, so that reactable compounds are again present. The compounds blocked with C 2- to C 8-alkanone oximes, in particular with butanone oxime, can be split open again at relatively low temperatures, which is why these blocking agents are preferred. Where appropriate, the reelimination can be speeded up by addition of catalysts, for example Sn-alkyl compounds.

The blocked low molecular weight polyurethane and the blocked polyisocyanate are used for obtaining the wash- and (dry) cleaning-resistant textile finish as extenders, that is to say as substances which improve the oil and water repellancy and also make possible a reduction in the amount of fluoroalkyl-containing compounds. For this purpose, amounts of 3 to 25% by weight, in particular 7 to 17% by weight, based on 100% strength reactive, perfluoroalkyl-containing (co)polymer and/or precondensate, are completely sufficient, so that larger amounts do not come into consideration if only on grounds of cost.

In the process according to the invention for treating textiles, the blocked NCO-containing compounds are added to the finishing liquor in emulsified form. These emulsions are prepared in conventional manner by using known emulsifiers and, in conclusion, are present in solvent-free form. These methods of preparation are known to those skilled in the art, and further explanation is not necessary.

However, a particular way of preparing the emulsion is necessary when using melamine precondensates as reactive $R_f$ precondensate. If such precondensates are used, then, to obtain liquors which are stable for a number of hours, the blocked NCO-containing compounds must be dissolved not alone but only together with a further known water-insoluble textile assistant in the solvent, where appropriate at slightly elevated temperature, and only then, as known, must this solution be stirred or turbined into an emulsifier-water mixture (the emulsifiers used can be commercially available products) and subsequently the mixture obtained be subjected to high-pressure homogenization. Finally, the solvent is as customary distilled off under reduced pressure at slightly elevated temperature and the emulsion is standardized to the desired solids content with water.

In addition to the various reactive perfluoroalkyl-containing (co)polymers and precondensates, it is also possible to use in the process according to the invention other customary textile assistants, which can even be added in the preparation of compounds (see above) but of course can also be added afterwards.

Such additives are customary crease resist and softening agents, flame retardants, oleophobizing agents, hydrophobizing agents, permanent set agents and others. It is of course also advisable to include, if necessary, known curing agents.

The process according to the invention serves for impregnating textiles of any kind from aqueous medium. Therein the water is of course used in varying amounts, depending on whether the material is impregnated, i.e. perfused, by pad-mangling, spraying, slop-padding or the like. Impregnation covers perfectly customary finishing methods which are familiar to those skilled in the art. These processes therefore require no particular explanation and it is possible to refer to the known literature. Moreover, details can be found in the examples. What is worth recording, however, is that the use of organic solvents in the process according to the invention is not necessary, said process being carried out in the absence of solvent.

The process according to the invention is suitable for impregnating textiles of any kind, whether they are in the form of woven, knitted or nonwoven fabrics. These can be made not only of natural fibers, such as cellulose or keratin fibers, but also of synthetic fibers, such as polyacrylonitrile, nylon, polyvinyl alcohol or polyester. It is of course also possible to use textile materials which consist of mixtures of natural with synthetic fibers. It is noteworthy that the process according to the invention can also be used for finishing loosely woven fabrics such as taffeta or loosely woven poplin fabrics. This is important for example for rainwear clothing, such as anoraks and the like.

Only the process according to the invention has made it possible to finish textiles with a water- and oil-repellant finish in such a way that these finishes are very highly wash- and/or (dry) cleaning-resistant.

It is true that the known processes have made some advances in this direction, but by the addition of the selected blocked low molecular weight polyurethanes and the blocked polyisocyanates this cleaning resistance is once more significantly improved (also see comparative examples), so that the effects obtained now meet all requirements in this respect.

In the examples below, the oil repellancy is tested by the method specified in AATCC 118-1972. The water repellancy is tested by DIN 53,888 (a=water absorption in %, b=beadoff effect) and by the spray test corresponding to AATCC 22-1974. Dry cleaning is carried out, unless otherwise stated, for 15 minutes using a liquor ratio of 10:1 (volume of liquor:weight of sample), the tetrachloroethylene used being renewed for every clean. The wash of the samples is carried out in whichever way is specified.

EXAMPLE 1

(a) Preparation of a blocked low molecular weight polyurethane 30 g of a 75% by weight strength solution of the reaction product from 3 mol of toluylene diisocyanate and 1 mol of trimethylolpropane (average molecular weight about 850) in ethyl acetate are dissolved in 67 g of methyl isobutyl ketone.

To this solution are added 7.0 g of butanone oxime, and the temperature rises to 60° to 70° C. At that temperature the mixture is then stirred for 20 minutes and examined by IR spectroscopy for the presence of NCO bands. As long as such bands are still detectable, 0.1 g portions of butanone oxime are added each time until NCO groups are no longer detectable.

(b) Emulsification of the blocked low molecular weight polyurethane together with perfluoro-modified polyurethane 97.8 g of a 50% strength solution of a perfluoroalkyl-modified polyurethane (see U.S. Pat. No. 3,968,066, Example (8) in butyl acetate, and 1.7 g of glacial acetic acid are stirred together and the mixture is heated to 70° C.

In a separate vessel:

8.8 g of the acetate of an ethoxylated fatty amine (about 10 mol of ethylene oxide per mol of fatty amine having C 16- to C 18-alkyl radical) and 245.0 g of water are heated to 70° C. with stirring. To this solution is added with high-speed mixing using a high-speed stirrer the solution of the blocked low molecular weight polyurethane and of the perfluoro-modified polyurethane. This preemulsion is then homogenized at 70° C. on a high pressure homogenizer at 300 bar to obtain the desired fine-dividedness. This emulsion is then subjected to an azeotropic vacuum distillation to remove the solvent, at at most 40° C., and is adjusted with water to a final amount of 383 g. On addition of a further 255 g of a 16% strength emulsion of a perfluoroalkyl-modified methylolmelamine ether (see European Offenlegungsschrift No. 073,364, Example (1) the result obtained is an emulsion having a solids content of about 20% by weight and containing 4.8% by weight of blocked low molecular weight polyurethane.

(c) Finish

A blue cotton twill (222 g/m$^2$) is pad-mangled with the following liquor:

30 g/l of the emulsion prepared in (b), 2 g/l of 60% strength acetic acid, 20 g/l of an aqueous approximately 50% strength solution of pentamethylolmelamine methyl ether, 30 g/l of a 45% strength aqueous solution of dimethyloldihydroxyethyleneurea and 8 g/l of magnesium chloride hexahydrate.

The liquor pickup is 78%. The fabric thus treated is then dried at 110° C. for 10 minutes and is then condensed at 150° C. for 5 minutes (finish A).

For the purposes of comparison, a finish B is carried out in the same way, except that the preparation of the emulsion is effected in the absence of the blocked low molecular weight polyurethane, but in turn the liquor makeup includes 20 g/l of a commercially available extender based on fat-modified synthetic resin (see for example German Pat. No. 1,233,874, Examples (1) and (4).

Technological testing gives the following oil and water repellancy values:

| | Original | | | after 3 × 60° C. machine washes | | after 3 × dry cleaning | | |
|---|---|---|---|---|---|---|---|---|
| | Water repellancy | | Oil | Spray | Oil | Water repellancy | | Oil |
| Emulsion | (a) | (b) | repellancy | test | repellancy | (a) | (b) | repellancy |
| A (according to the invention) | 13 | 5 | 5 | 3 × 100 | 4 | 13 | 5 | 5 |
| | | 5 | | | | | 4 | |
| | | 5 | | | | | 4 | |
| B (state of the art) | 18 | 4 | 5 | 3 × 50 | 3 | 34 | 3 | 3 |
| | | 4 | | | | | 2 | |
| | | 3 | | | | | 1 | |
| untreated | 96 | 1 | 0 | — | — | — | — | — |

Example 1 is repeated using the perfluoroalkyl-modified methylolmelamine ether corresponding to Example 2 B of European Offenlegungsschrift No. 073,364, affording similar results.

EXAMPLE 2

A liquor containing 24 g/l of the emulsion prepared in Example 1 under (b), 10 g/l of an approximately 50% strength aqueous amino resin precondensate solution (pentamethylolmelamine etherified with methanol) and 6 g/l of catalyst solution (approximately 75% strength aqueous zinc nitrate hexahydrate solution containing small amounts of hydrochloric and acetic acid) is used to pad-mangle (a) an acrylic fabric (214 g/m$^2$), (b) a polyester/cotton blend fabric (65/35; 208 g/m$^2$) and (c) a prewashed woven wool fabric (180 g/m$^2$) (liquor pickups 90, 60 and 78% respectively), which are dried at 110° C. for 10 minutes and condensed at 150° C. for 2.5 minutes. The fabrics thus finished have excellent initial oil and water repellancy values which are also highly resistant to a dry clean and a customary domestic wash.

EXAMPLE 3

The method described in Example 1 is used to block with butanone oxime the following polyisocyanates in succession: trimeric isophorone diisocyanate (A), DESMODUR RF from Bayer (B), trimeric hexamethylene 1,6-diisocyanate (C), hexamethylene 1,6-diisocyanate (D) and naphthylene 1,5-diisocyanate (E).

The blocked polyisocyanates thus prepared are converted as described hereinafter into a 25% strength emulsion, with which the following result is obtained:

Blocked (A), emulsifiability very good

Blocked (B) emulsifiability very good

Blocked (C), emulsifiability very good

Blocked (D), not emulsifiable

Blocked (E), not emulsifiable

The above list shows that only the polyisocyanates used according to the invention and having a molecular weight of above 450 are readily emulsifiable in blocked form and hence that only these products can be used without difficulties according to the invention.

To 100 g of methyl ethyl ketone are added at approximately 60° C. 100 g of the blocked polyurethane prepared as described hereinafter, and the temperature is raised to 60° C. The liquid consists of two non-miscible layers. It is added with high-speed mixing to a solution of 10 g of the emulsifier described in Example 1 in 290 g of water at a temperature of 60° C. and subsequently homogenized on a high pressure homogenizer, likewise at a temperature of 60° C. The solvent is then distilled off at 30° to 40° C. with stirring in vacuo, and the emulsion is brought to 25% by weight solids content with water.

490 g of the low molecular weight polyurethane described in Example 1 are presented in 375 g of methyl ethyl ketone in a three-necked flask equipped with thermometer, stirrer and reflux condenser, and 135 g of butanone oxime are added at room temperature. The temperature rises to 60° to 70° C. Stirring for 20 minutes is followed by an IR spectroscopy test for the presence of NCO bands. As long as such bands are still detectable, further butanone oxime is added in amounts of about 3 g. In this way 1,000 g of a 50% strength solution of the blocked polyurethane are obtained.

If the blocked products (A) to (C) are used in amounts of 15 g/l together with

- 30 g/l of the emulsion of a perfluoro-modified polyurethane corresponding to Example 11 A of U.S. Pat. No. 3,968,066 (solvent-free by azeotropic vacuum distillation),
- 10 g/l of copolymer dispersion (see German Auslegeschrift No. 1,419,505, Example 1),
- 40 g/l of approximately 50% strength aqueous dimethylolethyleneurea solution,
- 12 g/l of 60% strength acetic acid,
- 12 g/l of zirconium oxychloride solution (22% of $ZrO_2$) and
- 6 g/l of crystalline sodium acetate to prepare finishing liquors and an olive cotton sateen (about 300 g/m$^2$) is treated therewith in known manner (liquor pickup about 72%, drying and condensation as in Example 1), this gives excellent finishing effects which are very highly resistant even to DIN No. 83,892 boil washes.

EXAMPLE 4

The cotton twill described in Example 1(c) is finished in the manner specified there with the following treatment liquor:

- 24 g/l of the emulsion prepared under Example 1(b), which, however, contains in place of the blocked low molecular weight polyurethane the same amount of an identically blocked technical mixture of diphenylmethane diisocyanates,
- 2 g/l of 60% strength acetic acid,
- 30 g/l of an approximately 60% strength aqueous solution of dimethyloldihydroxyethyleneurea and
- 8 g/l of magnesium chloride hexahydrate.

The fabric thus finished has the following effects:

| original | | | after 3 × dry cleanings | | |
|---|---|---|---|---|---|
| Water repellancy | | Oil | Water repellancy | | Oil |
| (a) | (b) | repellancy | (a) | (b) | repellancy |
| 13 | 5 | 5 | 14 | 5 | 4 |
| | 5 | | | 4 | |
| | 5 | | | 4 | |

EXAMPLE 5

A cotton/polyester coat poplin (35/65; 200 g/m$^2$) is treated in the manner specified in Example 1 (liquor pickup about 65%):

- 25 g/l of the emulsion of Example 1 of European Offenlegungsschrift No. 073,364,
- 6 g/l of the emulsion described in Example 3 of the blocked polyurethane, which additionally contains 50 g of paraffin (melting point 52°–54° C.),
- 2 g/l of 60% strength acetic acid,
- 30 g/l of amino resin solution (approximately 52% strength aqueous solution of dimethylolethyleneurea and pentamethylolmelamine etherified with methanol, in a ratio of 2.5:1) and
- 8 g/l of catalyst solution according to Example 2 (liquor A).

For the purposes of comparison, the same fabric was finished in the same way, except that the emulsion of Example 3 contained only the paraffin (liquor B).

The fabrics thus finished have the following effects:

| | Original | | | after 3 × dry cleaning | | |
|---|---|---|---|---|---|---|
| | Water repellancy | | Oil | Water repellancy | | Oil |
| Liquor | (a) | (b) | repellancy | (a) | (b) | repellancy |
| A | 5 | 5 | 5 | 11 | 5 | 4 |
| | | 5 | | | 4 | |
| | | 5 | | | 4 | |
| B | 15 | 5 | 5 | 22 | 4 | 3 |
| | | 5 | | | 3 | |
| | | 5 | | | 3 | |

The addition of the blocked NCO-containing compounds according to the invention (liquor A) has the effect of significantly improving the starting values, but especially the resistance to dry cleaning.

We claim:

1. In a process for obtaining a wash- and dry-cleaning-resistant textile finish by impregnating the textile with a perfluoroalkyl-containing polymer and/or precondensate which contains a reactive OH or OR group, wherein R is an alkyl radical of 1 to 3 carbon atoms, applied in an aqueous dispersion, and subsequently heating the impregnated textile to cure the finish, the improvement wherein the aqueous dispersion further contains a blocked isocyanate compound, said compound before blocking being selected from the group consisting of isocyanate compounds having a molecular weight of at least 450 and diphenylmethane dissocyanate.

2. A process of claim 1, wherein the isocyanate compound has a molecular weight of at least 600.

3. A process of claim 1, wherein the blocked isocyanate compound is used in an amount of 3 to 25% by weight, based on the dry weight of perfluoroalkyl-containing polymer and/or precondensate.

4. A process of claim 1, wherein the blocked isocyanate compound is used in an amount of 7 to 17% by weight, based on the dry weight of perfluoroalkyl-containing polymer and/or precondensate.

5. A process of claim 1, wherein the aqueous dispersion containing the blocked isocyanate compound is organic-solvent-free.

6. A process of claim 1, wherein the blocked isocyanate compound is a blocked low molecular weight polyurethane.

7. A process of claim 6, wherein the blocked low molecular weight polyurethane has a polyol-polyisocyanate equivalent ratio of at least 1:1.3 and the excess isocyanate groups are blocked.

8. A process of claim 7, wherein the polyol-polyisocyanate equivalent ratio is 1:1.5 to 2.5.

9. A process of claim 1, wherein the blocked isocyanate compound is a blocked polyisocyanate.

10. A process of claim 1, wherein the aqueous dispersion further contains a textile assistant selected from the group consisting of crease resist agents, softening agents, flame retardants, oleophobizing agents, hydrophobizing agents and permanent set agents.

* * * * *